United States Patent [19]

Elmore et al.

[11] Patent Number: 4,514,910

[45] Date of Patent: May 7, 1985

[54] DEHYDRATION OF LIGNITE OR THE LIKE

[75] Inventors: Carl L. Elmore; Erwin D. Funk, both of Glens Falls, N.Y.

[73] Assignee: Kamyr, Inc., Glens Falls, N.Y.

[21] Appl. No.: 468,675

[22] Filed: Feb. 22, 1983

[51] Int. Cl.[3] ..... F26B 3/00

[52] U.S. Cl. ..... 34/15; 34/20

[58] Field of Search ..... 34/15, 13, 20; 209/11; 44/1 G

[56] References Cited

U.S. PATENT DOCUMENTS

| | | | |
|---|---|---|---|
| 1,632,829 | 6/1927 | Fleissner | 34/15 |
| 1,679,078 | 7/1928 | Fleissner | 34/15 |
| 3,007,254 | 11/1961 | Schuster | 34/35 |
| 3,552,031 | 1/1971 | Evans et al. | 34/9 |
| 3,802,956 | 4/1974 | Backlund | 162/19 |
| 3,982,789 | 9/1976 | Funk | 406/105 |
| 4,124,440 | 11/1978 | Sherman | 162/246 |
| 4,125,384 | 11/1978 | Funk | 48/86 R |
| 4,322,184 | 3/1982 | Funk et al. | 406/82 |
| 4,401,436 | 8/1983 | Bonnecaze | 44/1 G |

FOREIGN PATENT DOCUMENTS 2061393 5/1981 United Kingdom .

OTHER PUBLICATIONS

Stanmore et al., "Steam Drying of Lignite: A Review of Processes and Performance"; Technical Information Center, U.S. Dept. of Energy; Document DOE/G-FETC/RI-82/1, 1982.

Oppelt et al., "Drying North Dakota Lignite to 1,500 Pounds Pressure by the Fleissner Process"; Bureau of Mines Report 5527, 1959.

*Primary Examiner*—Larry I. Schwartz
*Assistant Examiner*—David W. Westphal
*Attorney, Agent, or Firm*—Cushman, Darby & Cushman

[57] ABSTRACT

A method and apparatus are provided for the dehydration of low rank coal, such as lignite. The coal is formed into particles having a size of less than about 4 inches, is subjected to atmospheric steaming, and then preheating with steam at a pressure of about 20–100 psig. The particles are then entrained in liquid and fed to a high pressure feeder at which they are transferred to a high pressure circulation loop, at a pressure of between about 300–1500 psig. The particles and liquid are fed to a liquid/particles separator at the top of a vertical dehydrating vessel, and the particles at the top of the vessel are contacted by saturated steam. Condensed steam and particles flow downwardly in the dehydration vessel, and are subjected to a counter-current wash at the bottom of the vessel. A slurry of liquid and particles discharged from the bottom of the dehydration vessel has the pressure thereof gradually reduced in a second high pressure feeder, and is transferred to a low pressure loop at a pressure of between about 20–100 psig. The liquid and particles are separated, and then the particles are subjected to evaporative cooling.

17 Claims, 1 Drawing Figure

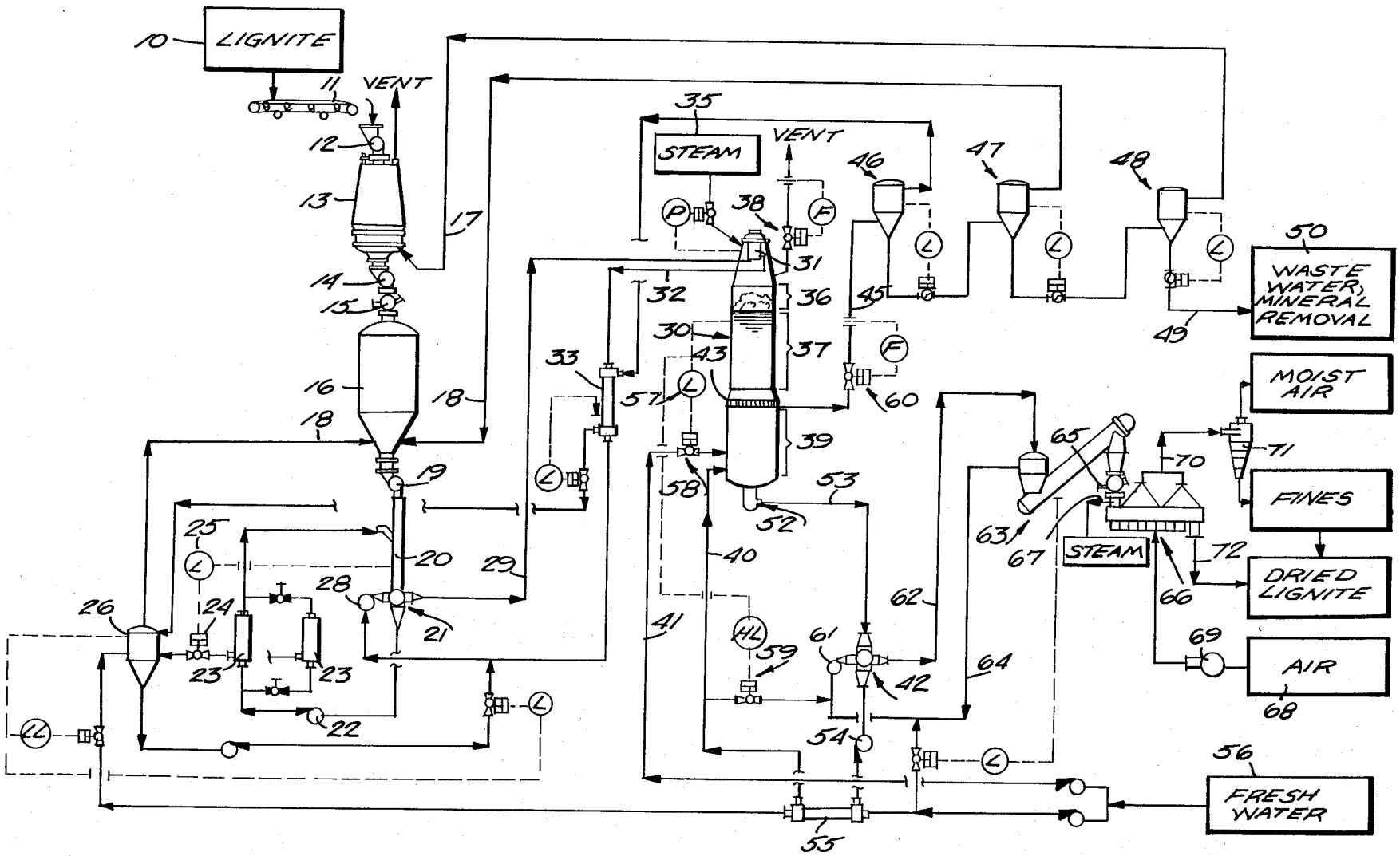
WASTE WATER MINERAL REMOVAL
MOIST AIR
FINES
DRIED LIGNITE
AIR
FRESH WATER
STEAM
STEAM
VENT
VENT
LIGNITE

DEHYDRATION OF LIGNITE OR THE LIKE

BACKGROUND AND SUMMARY OF THE INVENTION

One of the most theoretically effective methods for effecting dehydration of low rank coal, such as lignite and sub-bituminous coal, is steam drying. Low rank coals can typically have between about 30–65 percent water bound in the coal. This water reduces the BTU value per unit of weight of the coal, increases transportation costs, and makes handling more difficult. Therefore a method of efficiently dehydrating the coal is highly desirable.

Conventional processes for steam drying of low rank coal have not met with great commercial success. Typical prior steam drying processes are discussed in detail in report DOE/GFETC/RI-82/1 from the Technical Information Center of the U.S. Department of Energy entitled "Steam Drying of Lignite Coal and a Review of Processes and Performance" by Stanmore et al. This report points out that while batch processes for steam drying coal have been used commercially in the past, there has not been a commercially successful continuous process for steam drying of coal.

According to the method and apparatus of the present invention, it is possible to effectively continuously dehydrate coal utilizing a steam/water phase dehydrator. A key to the ability of the invention to accomplish this result is the ability to introduce and remove coarse particles of low rank coal into a pressure vessel (the steam/water phase dehydrator) continuously. The process and apparatus according to the present invention are advantageous since not only do they effect removal of about 60–80 percent of the water in low rank coal, they do so utilizing mostly commercially available equipment, efficiently utilize heat at all stages so that there is a minimum of energy use, and remove some sulfur, sodium, and other mineral contaminants from the coal, which contaminants can foul boilers and the atmosphere when the coal is burned during ultimate use thereof. Despite the activity in the field of low rank coal dehydration, and the pressing need for a commercially feasible continuous coal dehydration process, prior to the invention it had not been recognized that equipment commercially available for many years in the pulp and paper art could be adapted to effect continuous coal dehydration.

According to the present invention, low rank coal is particlized to a particle size of less than about 4 inches, and preferably less than about 2 inches. In the most specific procedures according to the invention, the particlized coal is steamed atmospherically, steamed again in a preheating vessel at a pressure of between about 20–100 psig, and entrained in water in a chute leading to a high pressure feeder. The high pressure feeder transfers the coal/liquid slurry to a particles/liquid separating structure at the top of a vertical pressurized dehydrator, the pressure in the dehydrator being maintained between about 300–1500 psig. Saturated steam contacts the coal particles at the top of the dehydrator, and condensed steam and coal particles move downwardly in the dehydrator in a column.

Wash water is introduced at the bottom of the dehydrator to effect washing and cooling of the coal particles at the bottom of the dehydrator. The spent wash water is flashed into steam, which is used for the previous atmospheric steaming steps, and at other stages in the process, and sulfur, sodium, and like minerals are ultimately removed from the spent wash water. The coal particles are discharged from the bottom of the dehydrator to the high pressure loop of a second high pressure feeder, which transfers the particles to the low pressure loop thereof and ultimately to a particles/liquid separator which operates at a pressure of between about 20–100 psig. The particles from the liquid/particles separator are subsequently passed to a vibrating dryer or the like, where they are subjected to evaporative cooling. Moist discharge gases from the vibrating dryer pass through a gas cyclone or the like to remove coal fines, which are combined with the coal particles discharged from the vibrating dryer to provide a dry, dehydrated, low rank coal suitable for easy transportation and efficient burning in conventional boilers and the like.

It is the primary object of the present invention to provide an effective continuous method—and apparatus for practicing the method—for dehydrating low rank coal, such as lignite and sub-bituminous coal. This and other objects of the invention will become clear from an inspection of the detailed description of the invention, and from the appended claims.

BRIEF DESCRIPTION OF THE DRAWING

The drawing FIGURE schematically illustrates exemplary apparatus according to the present invention, for practicing an exemplary method according to the present invention.

DETAILED DESCRIPTION OF THE DRAWING

The apparatus and method according to the present invention are utilizable for dehydrating low rank coal, such as lignite or sub-bituminous coal. By practicing the invention the water content of such low rank coals can typically be reduced 60–80 percent, and additionally some of the sulfur, sodium, and other mineral contaminants in the coal can be removed. This can all be accomplished utilizing a single source of steam which provides the heat for effecting dehydration, with maximum reuse of waste heat at various parts of the system, and with minimum consumption of fresh water.

Exemplary apparatus according to the present invention is shown in the drawing. For convenience, the invention will be described with respect to the dehydration of lignite.

Particlized lignite, having a particle size of less than about 4 inches, and preferably a particle size of less than about 2 inches (i.e. a maximum dimension of any particle is 2 inches), is discharged from source 10 onto conveyor 11, passing through air lock 12 to atmospheric steaming bin 13. The bin 13 may be of a conventional construction utilized in the pulp and paper field, such as shown in U.S. Pat. No. 4,124,440. The lignite passes through meter 14 and first low pressure feeder 15 to a preheating vessel 16. Steam is introduced through conduit 17 into bin 13, and through conduits 18 into preheating vessel 16. The particlized lignite then passes through another meter 19 to a vertical chute 20 which forms part of a low pressure circulation loop for a first high pressure feeder 21. An exemplary high pressure feeder that is utilizable in the practice of the present invention is shown per se in U.S. Pat. No. 3,982,789. Conventional feeder circulation loops, liquid level maintenance devices, and the like that are utilizable in the practice of the present invention are shown in U.S. Pat. No. 3,802,956.

In the chute 20 the particlized lignite is immersed in water, and flows in a first flow stream to the low pressure inlet to the first high pressure feeder 21. A screen is disposed at the low pressure outlet of the high pressure feeder 21, and liquid withdrawn therethrough by pump 22 passes through inline drainers 23, and the like, controlled by level control valve 24, to establish the desired liquid level in chute 20, which liquid level is sensed by level sensing structure 25. Some liquid passes to level tank 26, and a portion thereof is flashed into steam, which passes into a conduit 18.

High pressure pump 28 provides the pressure for the high pressure loop of first high pressure feeder 21, the pressure of the particlized lignite entrained in water being boosted to between about 300–1500 psig and the conduit 29 defining the second particle flow stream. The pressure in preheat vessel 16 is typically maintained proportional to the pressure in loop 29. For example the pressure in vessel 16 is maintained at a level about 1/15th the pressure in loop 29 (i.e. between about 20–100 psig).

The dehydrator 30 comprises a vertical pressure vessel having a conventional liquid/particles separating structure 31 disposed at the top thereof. A typical structure that may be utilized as the top separator is shown in U.S. Pat. No. 4,125,384, but a wide variety of other separating structures also are utilizable. Liquid separated by the separator 31 passes through conduit 32 to be returned to the pump 28 and high pressure feeder 21, and preferably a heat exchanger 33 is disposed in the conduit 32.

The lignite particles separated by the separator 31 at the top of the dehydrator 30 fall downwardly into the dehydrator 30 to establish a column of particles therein. Saturated steam, from steam source 35, is supplied to the top of the vessel 30 to contact the lignite particles in a steam phase. The steaming phase, or section, is illustrated generally by reference numeral 36. With the vessel at a pressure between about 300–1500 psig, the temperature established by the saturated steam will be between about 375° F. and 600° F. The exact pressure and temperature conditions are selected depending upon the type of lignite, or other low rank coal, that is to be treated. The pressure and temperature conditions vary widely depending upon the characteristics of the material being treated.

Condensed steam and lignite particles continuously flow downwardly in a column in the vessel 30, a dehydrating section 37 being established therein. Any noncondensable gases, such as carbon dioxide, which are evolved during treatment in the vessel 30 are vented from the top of the vessel 30 by vent structure 38.

At the bottom of the vessel 30 a wash section 39 is provided. A countercurrent flow of wash water is introduced by conduits 40, 41, and additionally displacement wash water from second high pressure feeder 42 passes upwardly in section 39 countercurrent to the lignite particles flow. Spent wash water withdrawal screen 43 is provided at the interface between the sections 37, 39, the annular screen 43 representing a temperature interface. Hot expelled water comes from the lignite particles in section 37 down to the screen 43, while cooler wash water introduced at the bottom of the vessel 30 comes up to the screen. The spent wash water is withdrawn through conduit 45, and is at substantially greater than 100° C., and therefore is flashed into steam in a series of flash tanks 46, 47, and 48. The spent wash water in conduit 49 from third flash tank 48 contains sulfur, sodium, and other mineral contaminants.

It ultimately may be passed to a station 50 for disposal, or for mineral recovery.

At the very bottom of the vessel 30 is a conventional particulate material discharge device 52, discharging the treated lignite particles into conduit 53 which defines a third flow stream for the particles, and forms part of the high pressure circulation loop for the second high pressure feeder 42. High pressure circulation line pump 54 withdraws high pressure liquid from second high pressure feeder 42, passes it through heat exchanger 55 to recover some of the heat energy thereof and lower the temperature thereof, and then the water is reintroduced into the vessel 30 through line 40 as wash water. Wash water in line 41 comes from a fresh water source 56, which also supplies—through heat exchanger 55—the level tank 26 with fresh water. Level sensing mechanism 57 senses the level of liquid in the vessel 30 and controls valve 58 in line 41, and valve 59 operatively connected between line 40 and the high pressure loop of second low pressure feeder 42, to—with the flow-controlled valve 60 in line 45—control the level of liquid in the vessel 30 to insure an appropriate steam section 36.

The second high pressure feeder 42 gradually reduces the pressure that the lignite particles are at so that breakup thereof is avoided. The low pressure line circulation pump 61 causes the lignite particles from low pressure feeder 42 to be fed to the low pressure loop 62, defining a fourth flow path. The pressure in loop 62 is proportional to the pressure in vessel 30; e.g. it is about 1/15th the pressure in vessel 30, or between about 20–100 psig. Line 62 leads to the particles/liquid separator 63, which effects liquid separation at the same pressure as in fourth flow path 62 (i.e. between about 20–100 psig). A typical structure utilizable as a separator 63 is shown in U.S. Pat. No. 4,322,184. Liquid from the separator 63 is returned by a line 64 to the high pressure feeder 42, while the lignite particles are discharged through second low pressure feeder 65 to an evaporative cooling mechanism 66, in a fifth flow stream, which mechanism 66 and fifth flow stream are at atmospheric pressure. Atmospheric steam is withdrawn at 67, and may be utilized at any desired part of the system (e.g. connected to line 17).

The evaporative cooling mechanism 66 preferably comprises a vibrating dryer, as illustrated schematically in the drawing. Even after atmospheric steam release, the lignite discharged through low pressure feeder 65 contains sensible heat which can be used to remove more water by evaporation. Ambient air from source 68 is blown by blower 69 through the vibrating dryer 66 to effect evaporative cooling of the lignite. The moist off-gases in conduit 70 from vibrating dryer 66 are passed to a mechanism for separating the lignite fines from the air, such as a conventional gas cyclone 71. The fines removed by cyclone 71 can be returned to the main stream 72 of dehydrated lignite exiting dryer 66 in a dry form.

The operating temperatures and pressures in the preheat vessel 16, dehydrator 30, and pressure let-down equipment 42, 63, etc., will be determined by the particular solid porous organic material being treated. Some low rank coals require lower temperatures than others to achieve maximum water expulsion efficiencies, and once the appropriate parameters are determined for a particular material, the process conditions can readily be adjusted to accomplish the desired results. By the present invention it is possible to reduce the water content of lignite or the like by about 60–80 percent with a minimum use of energy, and in a continuous high production manner, utilizing already commercially available equipment almost exclusively.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of dehydrating low rank coal comprising the steps of continuously:

(a) establishing a first flow stream of particulate low rank coal;

(b) preheating the first flow stream of particles with steam;

(c) immersing the first flow stream of particles in water;

(d) transferring the particles flowing in the first flow stream immersed in water to a second flow stream having a pressure substantially higher than in said first flow stream, and in the range of about 300–1500 psig;

(e) feeding the particles in the second flow stream to the top of a dehyration vessel, and separating the liquid from the particles at the dehydration vessel and recirculating the separated water to the second flow stream;

(f) exposing particles at the top of the dehydration vessel to saturated steam, condensing steam and particles flowing downwardly in a column in the dehydration vessel;

(g) effecting countercurrent washing of the particles at the bottom of the dehydration vessel to cool and wash the particles at the bottom of the dehydration vessel;

(h) withdrawing spent wash water from the dehydration vessel;

(i) gradually depressurizing the particles to prevent breakup thereof, as the particles are withdrawn from the bottom of the dehydration vessel in a third particle flow stream by transferring the particles flowing in the third flow stream to a fourth, lower—but super-atmospheric—pressure flow stream;

(j) separating the water from the particles in the fourth flow stream at a super-atmospheric pressure significantly lower than the pressure in the dehydration vessel, to flow the particles in a fifth flow stream; and (k) evaporatively cooling the particles flowing in the fifth flow stream to produce dehydrated low rank coal in a dry form.

2. A method as recited in claim 1 wherein steps (a) through (k) are practiced to reduce the water content of the low rank coal by about 60–80 percent.

3. A method as recited in claim 1 wherein step (b) is practiced by: initial atmospheric steaming of the particles, and then transferring the particles flowing in the first flow stream to a preheating vessel held at a superatmospheric pressure significantly less than the superatmospheric pressure in the dehydration vessel, and effecting steaming of the particles in the preheating vessel.

4. A method as recited in claim 3 wherein the existing super-atmospheric pressure, significantly below the dehydration vessel pressure, in practicing steps (b) and (j) is proportional to the pressure in the dehydration vessel.

5. A method as recited in claim 4 wherein the existing super-atmospheric pressure in steps (b) and (j) is between about 20–100 psig.

6. A method as recited in claim 1 comprising the further steps of: flashing the spent wash water withdrawn in step (h) into steam; and utilizing the steam to heat the water separated in step (e) and flowing in the second flow stream.

7. A method as recited in claim 6 wherein the wash water supplied in step (g) is supplied from water in said third flow stream that is displaced back into the dehydration vessel, and from a fresh water source; and comprising the further step of sensing the level of water in the dehydration vessel and controlling the flow of the fresh water wash water added in response to the liquid level sensed.

8. A method as recited in claim 6 wherein the steam flashed from the spent wash water is utilized to effect the preheating in step (b).

9. A method as recited in claim 1 wherein the wash water supplied in step (g) is supplied from water in said third flow stream that is displaced back into the dehydration vessel, and from a fresh water source; and comprising the further step of sensing the level of water in the dehydration vessel and controlling the flow of the fresh water wash water added in response to the liquid level sensed.

10. A method as recited in claim 1 comprising the further step of venting non-condensible gases evolved in the dehydration vessel from the top of the dehydration vessel.

11. A method as recited in claim 1 comprising the further step of eventually treating the spent wash water withdrawn in step (h) to effect removal of sodium, sulfur, and other minerals therefrom.

12. A method as recited in claim 1 wherein step (k) is practiced utilizing a continuous ambient air stream; and comprising the further step of treating the air stream in step (k) to remove fines of low rank coal therefrom.

13. A method as recited in claim 1 wherein the low rank coal is sub-bituminous coal having a particle size of less than about 4 inches.

14. A method as recited in claim 1 wherein the low rank coal is lignite.

15. A method as recited in claim 14 wherein the lignite has a particle size of less than about 2 inches.

16. A method of dehydrating low rank coal utilizing a vertical dehydrating vessel having a liquid/coal separator at the top thereof and a coal discharge structure adjacent the bottom thereof, comprising the steps of continuously:

entraining particles of low rank coal in liquid;

bringing the particles of low rank coal entrained in liquid to a pressure between about 300–1500 psig and feeding the particles-liquid slurry to the top separator of the dehydration vessel;

subjecting the low rank coal particles separated from the liquid at the top of the dehydration vessel to saturated steam;

gradually reducing the pressure of a slurry of liquid and low rank coal particles withdrawn from a bottom portion of the dehydration vessel to a level of about 20–100 psig; and separating the particles of low rank coal from the slurry at said pressure of between about 20–100 psig to provide a stream of dehydrated low rank coal particles.

17. A method of dehydrating low rank coal comprising the steps of continuously:

(a) establishing a first flow stream of particulate low rank coal;

(b) preheating the first flow stream of particles with steam;

(c) immersing the first flow stream of particles in water;

(d) transferring the particles flowing in the first flow stream immersed in water to a second flow stream having a pressure substantially higher than in said first flow stream;

(e) feeding the particles in the second flow stream to the top of a vessel, and separating the liquid from the particles at the top of the vessel and recirculating the separated liquid to the second flow stream;

(f) introducing heated fluid to the vessel, the heated fluid having a temperature sufficient to facilitate dehydration of the low rank coal particles;

(g) effecting countercurrent washing of the particles to cool and wash the particles;

(h) withdrawing spent wash water;

(i) depressurizing the particles of low rank coal and passing them in a third particle flow stream by transferring the particles flowing in the third flow stream to a fourth, lower pressure flow stream;

(j) separating the water from the particles in the fourth flow stream to flow the particles in a fifth flow stream; and (k) evaporatively cooling the particles flowing in the fifth flow stream to produce dehydrated low rank coal in a dry form.

* * * * *